US005779179A

United States Patent [19]

Zentmyer et al.

[11] Patent Number: 5,779,179

[45] Date of Patent: Jul. 14, 1998

[54] MANUAL STRETCH FILM APPLICATOR AND METHOD THEREFOR

[75] Inventors: Hugh J. Zentmyer, Green Oaks; Gale W. Huson, Glenview, both of Ill.

[73] Assignee: Illinois Tool Works Inc., Glenview, Ill.

[21] Appl. No.: 821,847

[22] Filed: Mar. 21, 1997

[51] Int. Cl.[6] ..... B65H 23/06; B44C 7/00

[52] U.S. Cl. ..... 242/423.2; 242/557; 242/596.5

[58] Field of Search ..... 242/423.2, 423.1, 242/557, 596.5, 596.6, 396.9; 53/390, 556, 587; 156/577

[56] References Cited

U.S. PATENT DOCUMENTS

| | | | |
|---|---|---|---|
| 1,067,643 | 7/1913 | Christner et al. | 242/396.9 |
| 1,217,211 | 2/1917 | Pico | 242/423.2 |
| 2,896,878 | 7/1959 | Wetzel | 242/396.9 |
| 3,140,059 | 7/1964 | Lusebrink . | |
| 4,166,589 | 9/1979 | Hoover et al. . | |
| 4,179,081 | 12/1979 | Parry . | |
| 4,248,392 | 2/1981 | Parry . | |
| 4,442,981 | 4/1984 | Cope | 242/423.2 |
| 4,477,037 | 10/1984 | Goldstein . | |
| 4,484,717 | 11/1984 | Goldstein . | |
| 4,530,473 | 7/1985 | Parry . | |
| 4,535,951 | 8/1985 | Riemenschneider | 242/423.2 |
| 4,714,211 | 12/1987 | Hwang | 242/423.1 |
| 4,722,493 | 2/1988 | Parry et al. . | |
| 4,872,623 | 10/1989 | Parry et al. . | |
| 4,989,803 | 2/1991 | Lambert et al. . | |
| 5,013,595 | 5/1991 | Parry . | |
| 5,203,517 | 4/1993 | Parry et al. . | |
| 5,409,177 | 4/1995 | Parry et al. . | |
| 5,535,955 | 7/1996 | Enger et al. | 242/596.6 |

*Primary Examiner*—John M. Jillions
*Attorney, Agent, or Firm*—Schwartz & Weinrieb

[57] ABSTRACT

A stretch film applicator and method therefor for manually wrapping stretch film supplied from a stretch film roll having a core. The stretch film applicator includes a substantially U-shaped handle member interconnecting a first core cap and a second core cap wherein the first core cap is disposeable over a first end of the core and the second core cap is disposeable over a second end of the core. An adjustably pre-loadable spring member is disposed between the first core cap and the first end portion of the handle member so as to bias the first core cap toward the second core cap and thereby rotatably retain the stretch film roll therebetween and frictionally drag the core as stretch film is supplied therefrom. A body member is coupled to the first end portion of the handle member and includes a through hole for reciprocatably receiving a post coupled to the first core cap, wherein the spring member is disposed between the body member and the first core cap. A lever is pivotally coupled to the first end portion of the handle member and to the post so as to move the first core cap against the bias of the spring member and away from the second core cap so as to release the stretch film roll rotatably retained therebetween. The core caps include a serrated surface engageable with a corresponding end of the core to increase drag on the core.

10 Claims, 2 Drawing Sheets

MANUAL STRETCH FILM APPLICATOR AND METHOD THEREFOR

FIELD OF THE INVENTION

The invention relates generally to stretch film applicators for manually wrapping stretch film about loads and methods therefor, and more particulaury to manual stretch film applicators for wrapping pre-stretched films.

BACKGROUND OF THE INVENTION

Manually operated devices for wrapping stretch film about packaged goods and parcels, referred to herein as loads, are known generally and are used in a substantial number of all film wrapping applications. These manual film wrapping devices are used, among other applications, where the size or shape or location of the load is not suitable for automated wrapping, where the number of loads to be wrapped does not justify automation costs, and generally to reduce the cost of film wrapping operations. In manual stretch film wrapping devices, the stretch film is supplied generally from a stretch film roll including a cardboard core that is rotatably disposed about a roll carrying member having handles and means for inducing, sometimes adjustably, drag on the core as stretch film is dispensed therefrom. U.S. Pat. No. 4,166,589 entitled "Portable Wrapping Film Dispenser" issued Sept. 4, 1979 to Hoover et al., for example, discloses a portable plastic film dispensing device including a roll carrying bar having handles at opposite ends thereof, and friction producing members that adjustably bind opposite ends of the film roll core so as to cause drag on the roll and thus tension on film supplied therefrom.

The drag on the stretch film roll of prior art manual film wrapping devices must be sufficiently great not only to tightly wrap film about the load, but also to permit the operator to stretch the film as film is supplied from the film roll. Previous manual stretch film wrapping devices thus required tremendous physical exertion in order to operate as a result primarily of the forces required to stretch the film during wrapping. The straining physical effort necessary to operate these devices was aggravated by the location of the handles at the ends of the film roll and by particular wrapping applications. More specifically, the extension of the operator's arms required to grip the separated handles caused discomfort, compromised body leverage and limited the operator's reach, particularly where overhead and near ground wrapping was required. Not surprisingly, previous manual stretch film wrapping devices were known notoriously for causing severe physical fatigue and other debilitating maladies. Previous manual stretch film devices also required at least partial disassembly to install and replace the stretch film roll, which was time consuming and created potential for lost parts. Moreover, installation and replacement of stretch film rolls in manual stretch film devices of the type having drag adjustment means invariably required readjustment of the film roll drag setting since the previous drag setting was released during disassembly. Also, the drag setting of some previous devices had a tendency to attenuate, or slip, over time. And in other devices the drag setting was sensitive to the orientation of the handles and thus had a tendency to change undesirably as the operator wrapped the film. For these and other reasons, previous manual stretch film wrapping devices, as a practical matter, had limited applicability and market potential.

The recent advent of pre-stretched film of a type known commercially as StrengthWrap™, available from ITW Mima, an Illinois Tool Works Company, in Boca Raton, Fla., eliminated substantially the forces required during application of film about the load. This is so because only a slight tension is necessary to firmly apply pre-stretched film about the load, whereupon the pre-stretched film shrinks itself to tightly wrap the load. It is thus not necessary to stretch the pre-stretched film during the wrapping process, thereby eliminating much of the fatigue associated with the application of non-pre-stretched films. Pre-stretched film may be dispensed from prior art manual film devices by substantially reducing the drag setting, but the devices still suffer from the ergonomic and many other problems discussed above. To overcome some of these problems, pre-stretched film has been dispensed directly from the film roll, whereby the operator inserted fingers in opposite ends of the film roll core so as to control tension on the film. But in this mode of operation it is difficult to consistently regulate tension on the film, and the operator eventually becomes very uncomfortable, particularly during extended wrapping operations, resulting in fatigue and other problems.

In view of the discussion above among other considerations, there exists a demonstrated need for an advancement in the art of manual stretch film applicators and methods therefor.

OBJECTS OF THE INVENTION

It is therefore an object of the invention to provide a novel manual stretch film applicator and method therefor that overcomes problems in the prior art.

It is also an object of the invention to provide a novel manual stretch film applicator and method therefor that reduces the tension that must be applied to the stretch film by the operator during wrapping, and in one embodiment a novel manual stretch film applicator and method therefor that supplies a pre-stretched film, thereby significantly decreasing the physical effort required to wrap film and substantially eliminating operator fatigue.

It is another object of the invention to provide a novel manual stretch film applicator and method therefor that provides improved operator ergonomics, and in one configuration by providing a substantially U-shaped handle member with a continuous gripping surface located along substantially the full extent of the handle member, improved gripping flexibility and comfort, improved balance and handling leverage, increased range of wrap accessibility, especially in overhead and near ground level applications, thereby reducing operator fatigue and increasing the relative ease with which an operator may manually wrap stretch film, and thereby decreasing the physical strength necessary to operate the stretch film applicator and thus increasing applicability and market appeal.

It is still another object of the invention to provide a manual stretch film applicator and method therefor that provides relatively quick film roll installation and release without disassembly of the stretch film applicator.

It is a further object of the invention to provide a novel manual stretch film applicator and method therefor that provides adjustable drag on the stretch film roll so as to facilitate wrapping the film, and in one configuration a relatively precisely adjustable pre-loadable spring member that does not require re-adjustment upon installation and replacement of stretch film rolls, and in still another embodiment a pre-loadable spring member that is insensitive to orientation of the handle and that will maintain drag settings over a relatively long time without requiring readjustment.

It is yet a further object of the invention to provide a manual stretch film applicator and method therefor that is lightweight and economical.

BRIEF DESCRIPTION OF THE DRAWINGS

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators throughout the several views, and wherein.

DETAILED DESCRIPTION OF THE INVENTION

Figure 1:
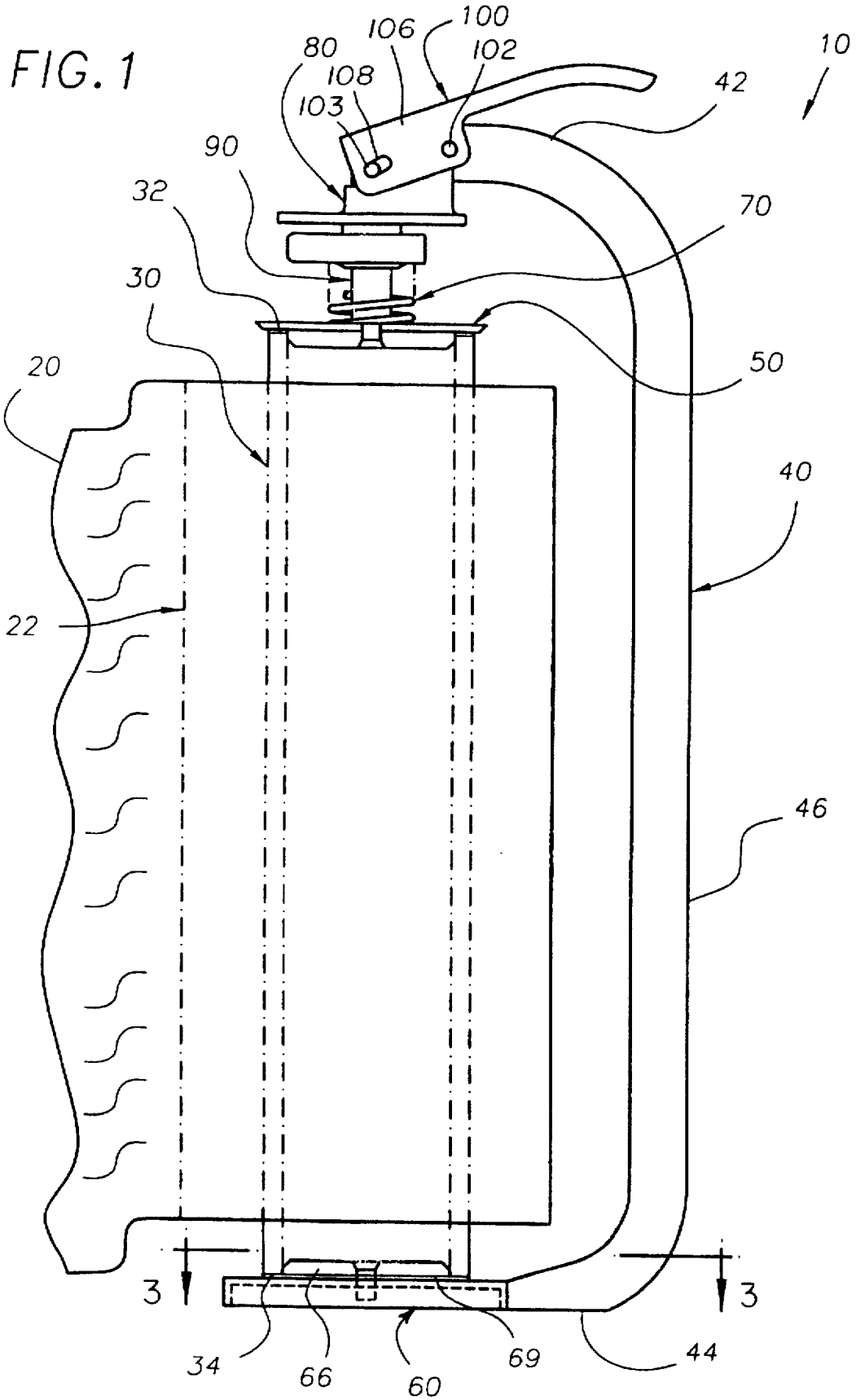
FIG. 1 is an elevational view of a manual stretch film applicator according to an exemplary embodiment of the invention.

FIG. 1 shows a manual stretch film applicator 10 for wrapping stretch film 20 supplied from a stretch film roll 22 including a core 30 with a first end 32 and a second end 34, and more particularly for wrapping pre-stretched film of the type known commercially as StrengthWrap™ available from ITW Mima, an Illinois Tool Works Company, Boca Raton, Fla. The applicator, however, may also be useful for dispensing non-pre-stretched films. The stretch film applicator 10 includes a substantially U-shaped handle member 40 having a first end portion 42 coupled to a first core cap 50 and a second end portion 44 coupled to a second core cap 60. The handle member 40 also includes an intermediate portion 46 having a continuous gripping surface between the end portions 42 and 44, which provides substantially improved gripping ergonomics among other advantages discussed hereinafter. The second end portion 44 of the handle member 40 and second core cap 60 have a relatively low profile relative to the second end 34 of the core 30 thereby facilitating film wrapping about loads without obstruction when wrapping near ground level and other objects.

According to another aspect of the invention, a spring member 70 is disposed between the first core cap 50 and the first end portion 42 of the handle member 40 whereby the spring member 70 biases the first core cap 50 toward the second core cap 60 to rotatably retain the stretch film roll 22 between the first and second core caps 50,60 and to frictionally drag the core 30 as stretch film 22 is supplied therefrom. According to a related aspect of the invention, the first core cap 50 is movable against the bias of the spring member 70 and away from the second core cap 60 thereby permitting removal and replacement of the stretch film roll rotatably retained therebetween without disassembly of the stretch film applicator 10. According to another related aspect of the invention, the frictional drag on the core 30 is adjustable by adjusting the pre-load on the spring member 70 disposed between the first end portion 42 of the handle member 40 and the first core cap 50 so as to adjustably bias the first core cap 50 toward and away from the second core cap 60. And in yet another related aspect of the invention, the frictional drag on the stretch film roll 22 is increased by engaging at least one end 32 or 34 of the core 30 with a serrated surface of at least one of the first or second core caps 50 and 60.

Figure 2:
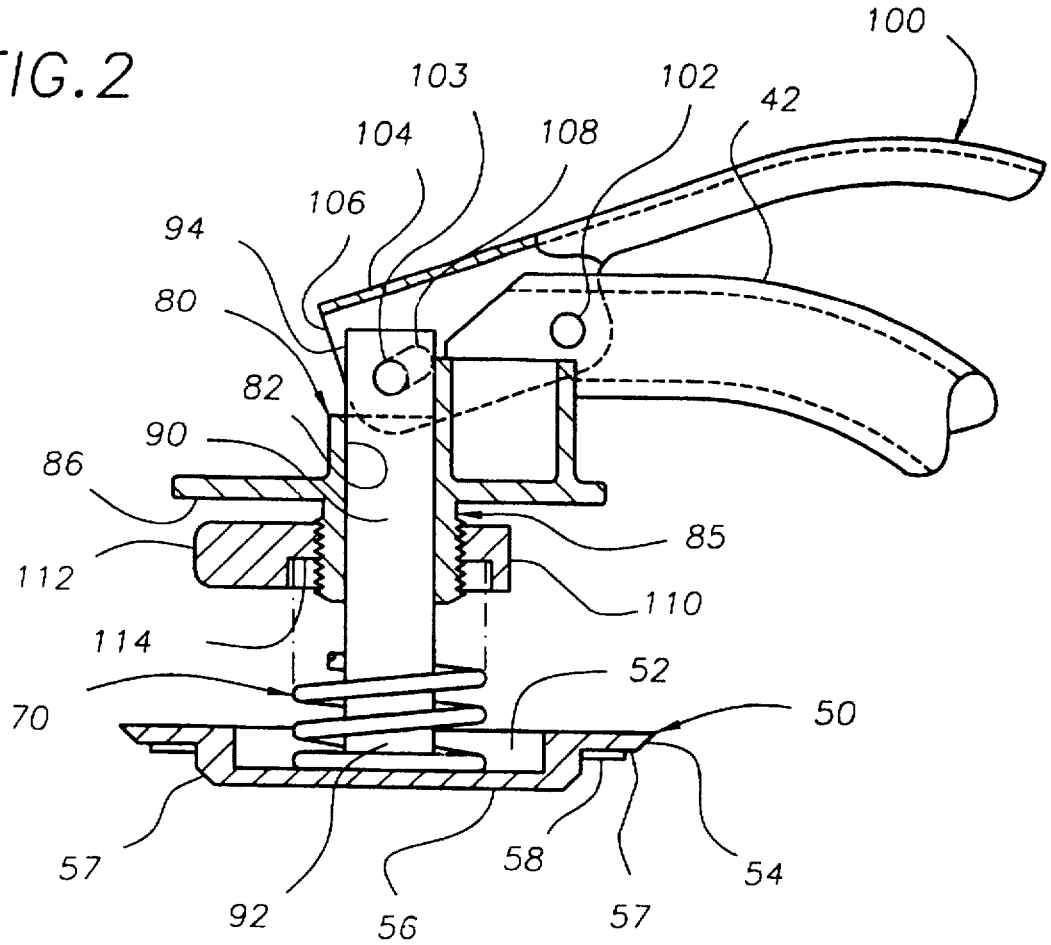
FIG. 2 is a partial sectional view of a film roll retention and release assembly portion of the stretch film applicator of FIG. 1.

In the exemplary embodiments of FIGS. 1 and 2, a body member 80 is coupled to the first end portion 42 of the handle member 40, and the body member 80 includes a through hole 82 for reciprocatably receiving a post 90 having a first end 92 fixedly coupled to the first core cap 50. In the exemplary embodiment, the sectional shapes of the through hole 82 and the post 90 are complementary, and moreover have a rectangular or other keyed configuration so as to prevent rotation of the post 90 relative to the body member 80. According to this general configuration, the spring member 70 is disposed between the body member 80 and the first core cap 50 so as to bias the first core cap 50 toward the second core cap 60 and thereby rotatably retain the film roll 22 therebetween. According to a related aspect of the exemplary embodiment, a lever 100 is pivotally coupled to the first end portion 42 of the handle member 40 by a pivot pin 102 at a corresponding pivot point, or fulcrum, and a first end portion 104 of the lever 100 is pivotally coupled to a second end portion 94 of the post 90 protruding through the through hole 82 of the body member 80 by a second pivot pin 103 at a corresponding pivot point. In FIGS. 1 and 2, the lever 100 includes a U-shaped first end portion 104 with opposing side walls 106, only one of which is shown, that straddle the post 90 and a portion of the first end portion 42 of the handle member 40 wherein the opposing side walls 106 carry the pivot pins 102 and 103. The side walls 106 include corresponding slots 108 wherein the pin 103 translates therein during pivoting action of the lever 100. According to this aspect of the invention, the lever 100 is pivotable so as to move the first core cap 50 against the bias of the spring member 70 and away from the second core cap 60 and thereby quickly release the stretch film roll 22 therebetween so as to permit quick installation of a new stretch film roll 22 without disassembly of the stretch film applicator 10.

According to another aspect of the invention, a threaded sleeve member 85 is coupled to the first end portion 42 of the handle member 40, and in the exemplary embodiment the threaded sleeve member 85 is an integral part of to the body member 80 and is disposed in alignment with the through hole 82 for reciprocatingly receiving the post 90. According to this aspect of the invention, a collar 110 is threadedly coupled to the threaded sleeve member 85, and the spring member 70 is disposed between the collar 110 and the first core cap 50 whereby the collar 110 is rotatably adjustable toward and away from the first core cap 50 so as to adjustably pre-load the spring member 70 therebetween. The adjustable pre-load on the spring member 70 provides an adjustable bias of the first core cap 50 more or less toward, or relative to, the second core cap 60 thereby adjusting the drag on the core 30 of the film roll 22 disposed therebetween. According to a related aspect of the invention, it is not necessary to re-adjust the drag setting upon removal or installation of the stretch film roll 22 since pivoting of the lever 100 so as to move the first core cap 50 away from the second core cap 60 has no affect on the pre-load of the spring member 70 and hence on the drag setting.

According to another aspect of the invention, the collar 110 includes one or more knobs 112 protruding from an outer side of the collar 110 so as to facilitate manual adjustment of the pre-load on the spring member 70, and the body member 80 includes a disk shape flange member 86 disposed protectively adjacent to and extending outwardly over the collar 110 so as to prevent inadvertent obstruction or interference therewith and yet provide free and ready access thereto.

In the exemplary embodiments, the spring member 70 is a coil spring, which may be pre-loaded, disposed about the post 90 and seated in a recess 52 of the first core cap 50 and in a recess 114 in the collar 110. In applications where the stretch film is a pre-stretched film, like StrengthWrap™ available from ITW Mima, the spring force of the spring member 70 is preferably not greater than required to bias the first core cap 50 toward the second core cap 60 so as to frictionally drag the core 30 and thereby permit wrapping the pre-stretched film about the load relatively tightly. Since it is not necessary to stretch the pre-stretched film, but only to wrap it tightly about the load, this spring force and corresponding drag on the core in pre-stretched film applications is necessarily and considerably less than the drag required to stretch a non-pre-stretched film. According to this aspect of the invention, the relatively low spring force required for pre-stretched film applications significantly decreases the force required to pivot the lever 100 for releasing and installing pre-stretched film rolls and provides relatively reduced drag on the stretch film roll. According to a related aspect of the invention, the relatively long length of the spring member 70 and corresponding long displacement stroke of the first core cap 50 relative to the second core cap 60 remarkably reduces any undesirable attenuation of the drag setting resulting from relaxation of the spring member 70 over time. The drag setting is thus readily and accurately adjustable without requiring re-adjustment to compensate for weakening of the spring member over time.

Figure 3:
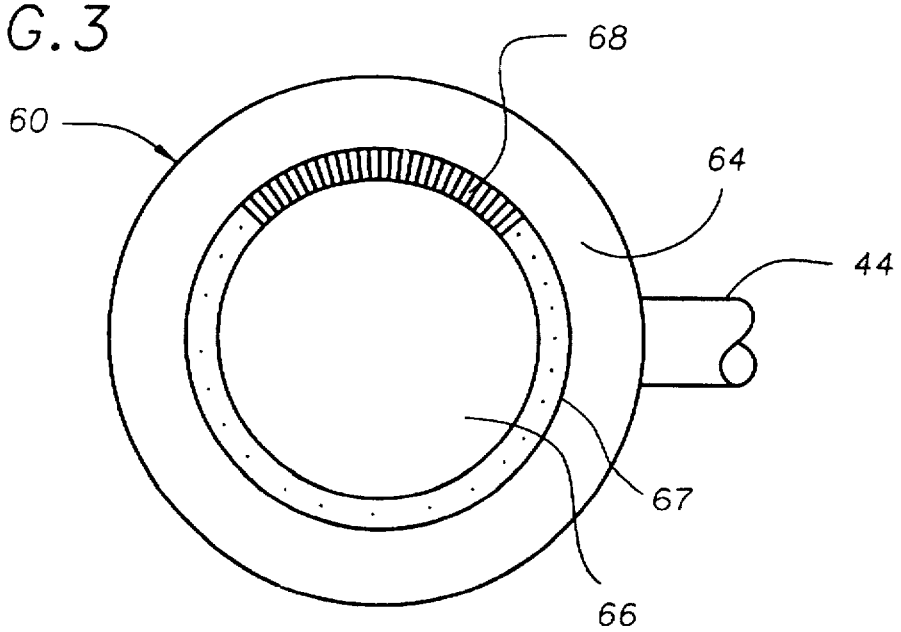
FIG. 3 is a plan view along lines 3—3 of a portion of the stretch film applicator of FIG. 1.

According to another aspect of the invention shown in FIG. 1, the first core cap 50 has a base portion 54 with bevelled edges 57 and a core guide 56 which is protrudable into an open defined in the first end 32 of the core 30. In FIGS. 1 and 3, the second core cap 60 also includes a base portion 64 with bevelled edges and a core guide 66 which is protrudable into a corresponding open defined in the second end 34 of the core 30. According to this aspect of the invention, the core guides 56 and 66 rotatably retain the stretch film roll 22 between the first and second core caps 50,60, and surfaces 57 and 67 of corresponding base portions 56 and 66 frictionally engage corresponding first and second ends 32 and 34 of the core 30 so as to drag the stretch film roll 22 under the adjustable bias of the first core cap 50 toward the second core cap 60 by the spring member 70. According to a related aspect of the invention shown in FIGS. 2 and 3, one or both of the surfaces 57 and 67 include corresponding annular serrated portions 58 and 68 so as to increase the frictional drag on the ends of the core 30. According to this aspect of the invention, the increased drag resulting from the serrations 58 and 68 permits a reduction in the bias of the first core cap 50 toward the second core cap 60 and hence a reduction of the spring force of the spring member 70. According to a related aspect of the invention, the base portion 64 of the second core cap 60 is substantially circular with a relatively large diameter compared to the first core cap 50 so as to provide a stable stand on which the stretch film applicator 10 may be oriented and supported in an upright position.

In the embodiment of FIGS. 2 and 3, the first and second core caps 50 and 60 are unitary metal members with serrations formed thereon. In the embodiment of FIG. 1, the first and second core caps 50 and 60 form an assembly including a separate core guide secured to a base portion by a screw or other fastening member with a frictional plate 69 secured therebetween as shown on the second core cap 60. The body member 80 and threaded sleeve member 85 may similarly be formed of a unitary metal material. The second core cap 60 and the body member 80 are weldable to corresponding end portions of the handle member 40, and in one embodiment the stretch film applicator 10 is fabricated from aluminum or other light weight yet durable material.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A stretch film applicator for manually wrapping stretch film supplied from a stretch film roll having a core with a first end and a second end, the stretch film applicator comprising:

a substantially U-shaped handle member;

a first core cap coupled to a first end portion of the handle member, and a second core cap coupled to a second end portion of the handle member, the first core cap being disposed over the first end of the core of the stretch film roll and the second core cap being disposed over the second end of the core of the stretch film roll; and a spring member disposed between the first core cap and the first end portion of the handle member, wherein the spring member biases the first core cap toward the second core cap so as to rotatably retain the stretch film roll between the first core cap and the second core cap and to induce frictional drag upon the core of the stretch film roll as stretch film is supplied from the stretch film roll.

2. The stretch film applicator of claim 1, further comprising:

a post having a first end portion coupled to the first core cap;

a body member coupled at a first end portion thereof to the first end portion of the handle member, the body member having a through hole for reciprocatably receiving the post; and a lever pivotally coupled to the first end portion of the handle member, the lever having a first end coupled to a second end of the post;

the spring member being disposed between the body member and the first core cap whereby the lever is pivotable so as to move the first core cap against the bias of the spring member and away from the second core cap so as to release the stretch film roll rotatably retained between said first and second core caps by said first and second ends of said stretch film roll core.

3. The stretch film applicator of claim 2, further comprising:

a threaded sleeve member coupled to the body member; and a collar threadedly mounted upon said threaded sleeve member;

the spring member being disposed between the collar and the first core cap; and the collar is rotatably adjustable upon said threaded sleeve member so as to be movable toward and away from the first core cap so as to adjustably bias the first core cap relative to the second core cap and thereby adjust the drag upon the core of said stretch film roll.

4. The stretch film applicator of claim 1, further comprising:

a serrated surface on at least one of the first and second core caps, the serrated surface being engageable with a corresponding end of the core of the stretch film roll so as to increase the drag on the core of the stretch film roll.

5. The stretch film applicator of claim 1, wherein:

at least one of the first and second core caps includes a core guide protrudable into a corresponding opening of the first and second ends of the core of the stretch film roll.

6. The stretch film applicator of claim 1, wherein:

the stretch film is a pre-stretched film; and the spring member has a spring force that provides less drag on the core of the stretch film roll than necessary to stretch a non-pre-stretched film.

7. A method of manually supplying stretch film from a stretch film roll having a core with a first end and a second end, the method comprising the steps of:

providing a first core cap for engaging the first end of the core of the stretch film roll, and a second core cap for engaging a second end of the core of the stretch film roll;

connecting the first core cap to a first end portion of a substantially U-shaped handle member and connecting the second core cap to a second end portion of the substantially U-shaped handle member; and biasing the first core cap toward the second core cap, with a spring member disposed between the first core cap and the first end portion of the handle member, so as to induce frictional drag forces upon the core of the stretch film roll rotatable disposed between the first core cap and the second core cap as stretch film is supplied from the stretch film roll.

8. The method of claim 7, further comprising the steps of:

moving the first core cap against the bias of the spring member and away from the first end of the core of the stretch film roll so as to release the stretch film roll rotatably retained between the first and second core caps.

9. The method of claim 7 further comprising the steps of:

adjusting frictional drag on the core by adjusting the pre-load on the spring member disposed between a collar, operatively connected to the first end portion of the handle, and the first core cap so as to adjustably bias the first core cap relative to the second core cap.

10. The method of claim 7, further comprising the steps of:

increasing the frictional drag on the stretch film roll by engaging at least one end of the core with a serrated surface of at least one of the first and second core caps.

* * * * *